US008636255B2

(12) United States Patent
Rodrigues

(10) Patent No.: US 8,636,255 B2
(45) Date of Patent: Jan. 28, 2014

(54) STAND FOR A MUSICAL INSTRUMENT

(76) Inventor: Cristina Rodrigues, Midrand (ZA)

( * ) Notice: Subject to any disclaimer, the term of this patent is extended or adjusted under 35 U.S.C. 154(b) by 183 days.

(21) Appl. No.: 13/141,413

(22) PCT Filed: Aug. 13, 2010

(86) PCT No.: PCT/ZA2010/000042

§ 371 (c)(1),
(2), (4) Date: Aug. 3, 2011

(87) PCT Pub. No.: WO2011/066591

PCT Pub. Date: Jun. 3, 2011

(65) Prior Publication Data

US 2011/0303804 A1 Dec. 15, 2011

(30) Foreign Application Priority Data

Aug. 14, 2009 (ZA) ..... 2009/05646

(51) Int. Cl.
*A47G 23/02* (2006.01)

(52) U.S. Cl.
USPC ..... 248/154; 84/453; 248/158

(58) Field of Classification Search
USPC ..... 248/160, 292.12, 176.1, 176.3, 158, 248/154, 127; 84/453; 211/85.7, 196, 197, 211/1.3, 205, 13.1
See application file for complete search history.

(56) References Cited

U.S. PATENT DOCUMENTS

| | | | | |
|---|---|---|---|---|
| 5,121,890 | A | 6/1992 | Komada | |
| 5,438,936 | A * | 8/1995 | Wang | 108/44 |
| 7,105,732 | B1 | 9/2006 | Hsieh | |
| 7,984,886 | B2 * | 7/2011 | Lin | 248/181.1 |
| 2005/0236536 | A1 * | 10/2005 | Fan | 248/176.3 |
| 2009/0151538 | A1 | 6/2009 | Lippert et al. | |
| 2010/0044534 | A1 * | 2/2010 | He et al. | 248/188.8 |

FOREIGN PATENT DOCUMENTS

| | | |
|---|---|---|
| DE | 20 2004 007 394 | 8/2004 |
| EP | 2 071 559 | 6/2009 |

OTHER PUBLICATIONS

International Search Report issued May 5, 2011 in International (PCT) Application No. PCT/ZA2010/000042.

* cited by examiner

*Primary Examiner* — Alfred J Wujciak
(74) *Attorney, Agent, or Firm* — Wenderoth, Lind & Ponack, L.L.P.

(57) ABSTRACT

A stand for a musical instrument which includes a ground-engaging base, a post that extends from the base, and a clamp assembly attached to the post. The clamp assembly includes a pair of clamping arms, each of which is variably spaced relative to the other along an axis transverse to the post, to detachably engage a respective side of the instrument, when placed therebetween, to hold the instrument in a convenient position for a user to access and play.

9 Claims, 9 Drawing Sheets

STAND FOR A MUSICAL INSTRUMENT

BACKGROUND OF THE INVENTION

The invention relates generally to supports for stringed musical instruments and more specifically to a support for a violin.

Violins and violas are delicate yet expensive musical instruments and, partially as a result of the profusion of curved surfaces on these instruments, they are not easily, yet also accessibly, stored when not immediately needed, during intervals in a rehearsal or a performance.

These instruments cannot safely be mounted against a wall or placed on a table or the floor as they can easily be accidentally kicked or knocked.

Also, violinists have employed the practice of storing their violin in the case, between rehearsals, so as to protect the instrument. This practice of packing away the violin, in its case, after each rehearsal and then unpacking it for the next rehearsal, often in the same day, is a time consuming and inconvenient practice.

The invention aims to address the aforementioned difficulties.

SUMMARY OF INVENTION

The invention provides a stand for a musical instrument which includes a ground-engaging base, a post which extends from the base and a clamp assembly, attached to the post, which includes a pair of clamping arms, each of which is variably spaced relatively to the other along an axis transverse to the post, to detachably engage a respective side of the instrument, when placed therebetween, to hold the instrument in a convenient position for a user to access and play.

Preferably, the musical instrument is a violin or a viola (hereinafter collectively referred to as a violin) and the clamping arms detachably engage the violin at a respective centre bout on either side thereof.

To accommodate violins of a variety of lengths and to ensure that a violin of any particular length is elevated above the ground, so as not to scuff and mar the violin, and to accommodate the specific requirements of a violin player, at least one of the following parameters may be varied: the vertical distance between the base and the clamping arms and the height of the post.

The post may include at least two components which are inter-engageable at respective ends to provide for easy assembly and disassembly of the post and variation of the post height.

The clamping assembly may include a head-piece to which each of the clamping arms is attached, directly or indirectly, and to which a top end of the post is attached in engagement of the clamping arms to the post.

The clamping arms may be pivotally moveable with respect to the head-piece between an operative position in which the arms extend laterally relatively to the post and an inoperative or storage position in which the arms lie longitudinally adjacent the post.

Preferably, in the operative position, the arms are orientated in a range of 15° to 25° above the horizontal to gravitationally aid in keeping the violin clamped within the arms.

Variable spacing of the arms may be achieved by a number of different means.

Therefore, the invention provides, in a first aspect, each arm being substantially "L" shaped with each arm including a first post-adjacent section and a second instrument-engaging section, substantially perpendicular to the first section and wherein the arms may be telescopically inter-engaged at respective ends of the first sections.

Each arm may be variably spaced from the other by varying the depth of the telescopic inter-engagement of the respective first sections.

To provide for a plurality of pre-set horizontally spaced positions, each of the inter-engaging first sections may have a plurality of formations spaced at intervals along the section which, when a pair of corresponding formations are in register, set the arms in position.

The pair of corresponding formations may be complementary and comprise a protrusion or nub and a recess respectively. Alternatively, the pair of corresponding formations may be a pair of holes which, in register, provide a channel through the overlapping first sections into which a bolt or similar device may pass to set the arms in position.

In a second aspect, the assembly may include a cross bar which is mounted to the head-piece to extend laterally therefrom and to which each of the clamping arms is rotationally engaged.

Each arm may be slidably engaged with the cross bar to allow displacement, axially with respect to the cross bar, of one arm relatively to the other. Alternatively, only one of the arms is slidably engaged to the cross bar, the other being fixedly attached.

Each arm may be attached to the cross bar by means of a bracket of suitable configuration.

The arms may be fixed in position, on the cross bar, when suitably horizontally disposed with respect to the violin to be clamped, by any suitable fastening means. The fastening means may be, for example, a grub screw threadedly engaged through the bracket of a respective arm to abut and frictionally engage the cross bar.

In another aspect of the invention, each arm may include a gear bar or rack, each of which laterally and inwardly extends from a respective arm to lie, at least partially, in parallel relationship with one another, preferably, at or within the head-piece.

The clamping assembly may include a pinion which is arranged to engage with each of the racks so that, when the pinion is caused to rotate, by a user of the stand, each rack is caused to move inwardly or outwardly, relatively to the pinion along an axis transverse to the post to variably space the arms.

Preferably, the pinion is housed within the head-piece.

The clamping assembly may include an actuator which is easily accessible to the user and which is attached to the pinion to transmit rotational motion, which is applied to the actuator, to the pinion.

The actuator may include a hand-held member, a stop formation underlying the member and a shaft which connects the member to the pinion.

The head-piece may include a slot which provides a channel along which the actuator can travel when used to pivotally move the clamping arms between the operative and the inoperative positions.

The slot may have, at each of its ends, an end formation, each of which operationally defines the operative and the inoperative positions respectively.

The hand-held member of the actuator may include a housing member which attaches the member to the shaft and which biases the member axially inwardly.

The stop formation of the actuator may be complementally shaped to each of the slot end formations to locate therein, when the member is inwardly biased, to prevent movement of the actuator along the slot.

Each of the arms may include, perpendicularly attached to respective distal ends, a finger projection, each of which points inwardly, in use, to provide a retaining means to the violin clamped between the arms, so that the violin cannot disengage from the arms when, for example, the post pivots forwardly about the base.

Each finger projection may be rotatable about a longitudinal axis of the respective arm.

Each of the arms may be at least partly enclosed with a pressure absorbent material, for example foam rubber, to provide a degree of protection to the surfaces of the violin onto which the arms come into contact.

BRIEF DESCRIPTION OF THE DRAWINGS

The invention is further described by way of examples with reference to the accompanying drawings in which.

DESCRIPTION OF PREFERRED EMBODIMENT

Figure 1:
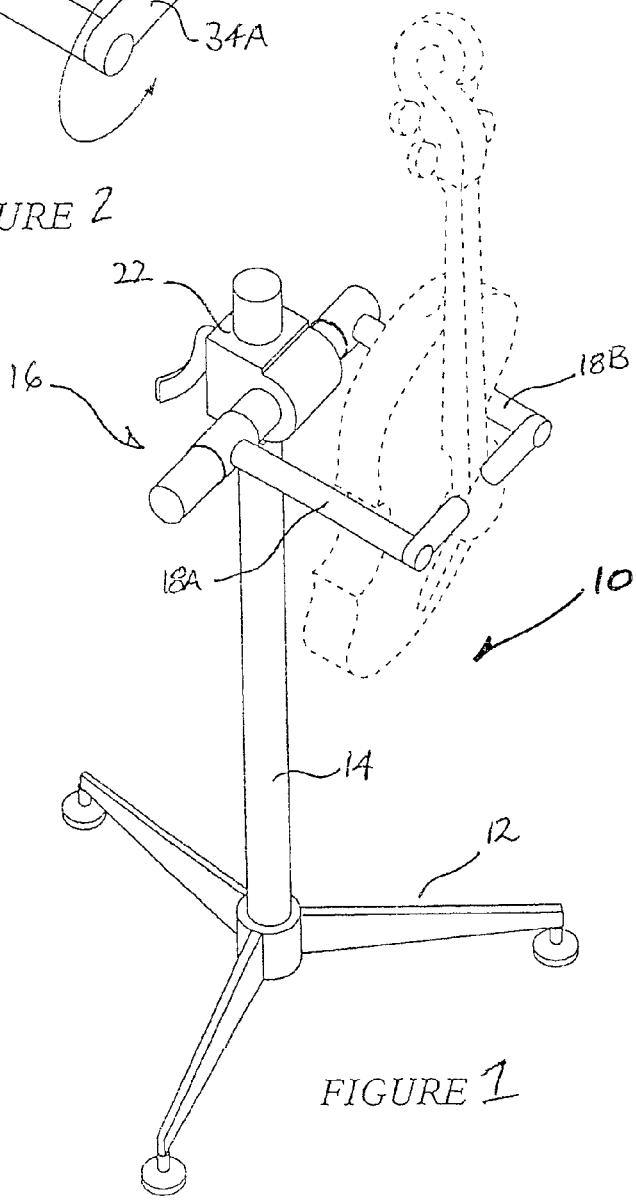
FIG. 1 is an isometric view of a musical instrument stand in accordance with a first embodiment of the invention.

FIG. 1 of the accompanying drawings illustrates a stand 10 for a musical instrument, such as a violin (shown in dotted outline), which includes a ground-engaging base 12, a post 14 which extends substantially vertically upwardly from the base and a clamp assembly 16 which is attached to an upper section of the stand and which includes a pair of arms, respectively designated 18A and 18B.

Each of the arms is variably horizontally spaced relatively to the other and, in use, detachably engages a respective bout section of the violin.

To accommodate the variety of lengths of the musical instrument the stand 14 is capable of vertically variable adjustment. This feature can be enabled by providing a stand comprising of two stand components (not shown) which are telescopically inter-engageable at a lower end and upper end respectively to form a joint (not shown). The joint can be provided with a securing mechanism (not shown) which is loosened to adjust the height and then tightened to secure the stand at that specific height.

The clamp assembly includes a head piece 22 which engages with an upper end 24 of the stand and which may be removed from the post 14, when the stand is not in use, by simply unsecuring a fastening device 20 which secures the head piece to the upper end.

Each arm is slidably engaged with a cross bar 36, which projects through and from either side of the head piece.

This configuration allows each arm to be independently vertically moveable, in use, from a clamping configuration in which each arm engages the musical instrument, and an unclamped configuration in which they disengage the musical instrument to release the instrument.

Figure 2:
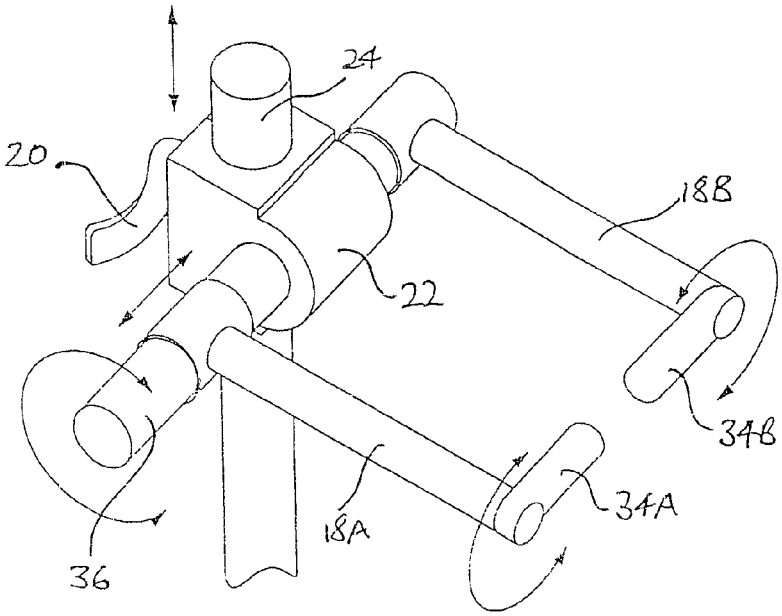
FIG. 2 is an isometric view of an upper section of the stand of FIG. 1.

Furthermore, the arms can be tilted upwardly, relatively to the base 12, by axially rotating the bar 36 (as illustrated by an arrow in FIG. 2), to provide a further means to ensure that the violin, clamped within the arms, does not fall from the clamping assembly. In this tilted configuration, the violin is gravitationally aided to stay within the assembly.

Figure 3:
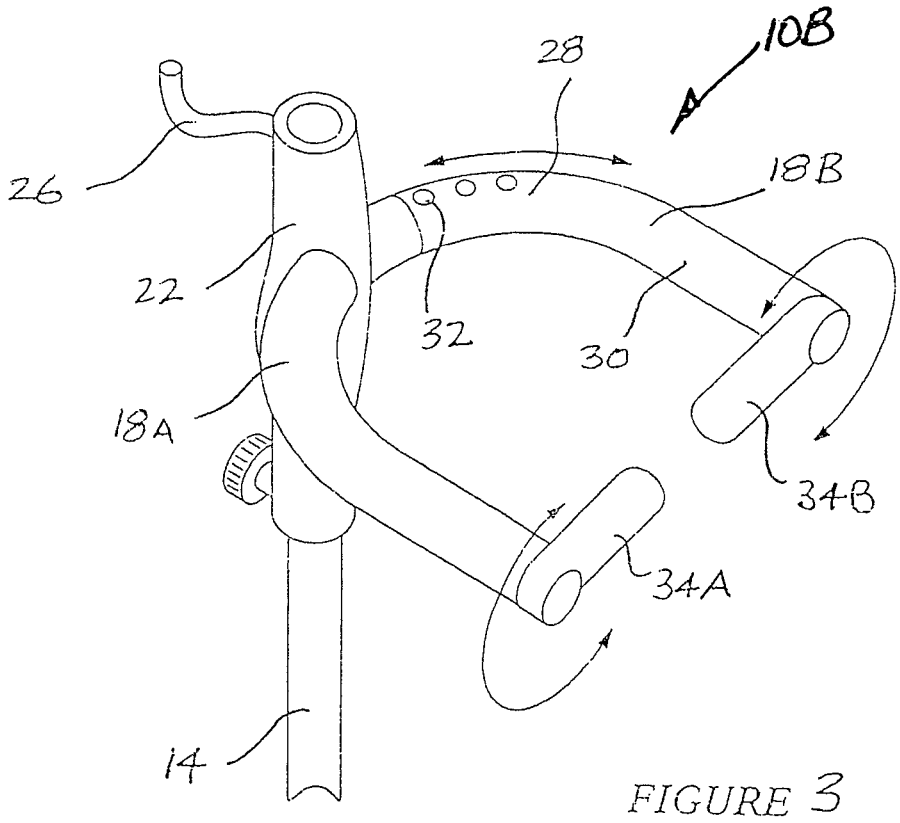
FIG. 3 is an isometric view of an upper section of the stand in accordance with a second embodiment of the invention.

The invention extends to a second embodiment of the stand 10B which is described with reference to FIG. 3, wherein like features bear like designations.

The head piece also includes a hook formation 26, projecting in an opposing direction to the arms onto which a violin bow can be attached, conveniently stored off the ground.

Each of the arms is substantially "L-shaped", with a first head piece engaging section 28 and a second violin engaging section 30.

The arms are telescopically inter-engaged at respective first sections, with arm 18A, at its first section, passing into the first section of counterpart arm 18B. This feature provides variable horizontal spacing between the respective parallel second sections 30 of the arms to accommodate varying widths of musical instrument.

To set the arms in a particular horizontally spaced position, each arm is provided with a plurality of regularly spaced complementary formations which, when a pair of respective formations is in register, set apart the second sections of the arms at a particular distance.

In the preferred embodiment, these formations are, on arm 18A, at least one protrusion (not shown) and, on arm 18B, a series of recesses 32. Each protrusion can be spring-loaded or biased to protrude. In setting the arms at a particular horizontally spaced position, to clamp the violin therebetween, arm 18A can be moved outwardly or inwardly (indicated with a bi-directional arrow in FIG. 3) relatively to arm 18B until the desired clamping position is obtained at which point the protrusion is moved in register with the closest applicable recess 32 to project through the recess and secure the arms in that particular position.

Each arm is provided with a finger projection, respectively designated 34A and 34B, each of which is attached to respective outer ends of the arms in pivotal engagement. These finger projections, in use and once the violin is clasped within the arms, are rotated inwardly to points at which the projections point inwardly towards each other, to provide a barrier to the violin, clamped between the arms, from falling from the clamping assembly 16.

Figure 4:
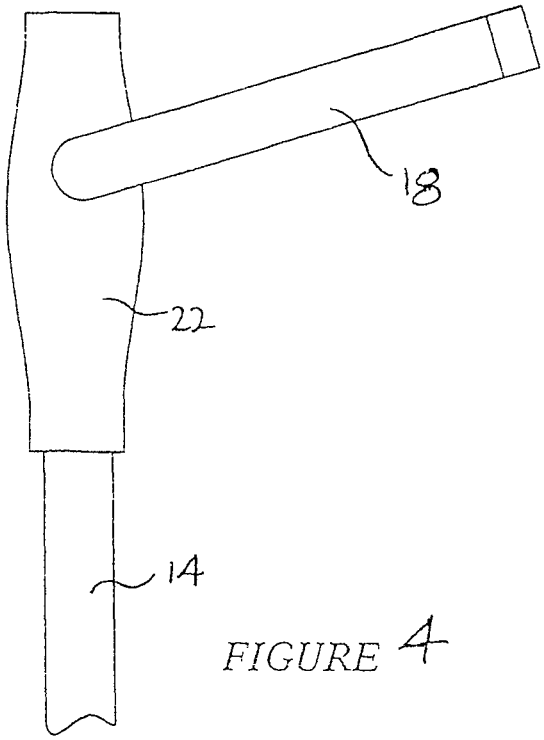
FIG. 4 is a side view of the upper section of FIG. 3 illustrating the arms in an operative position.
Figure 5:
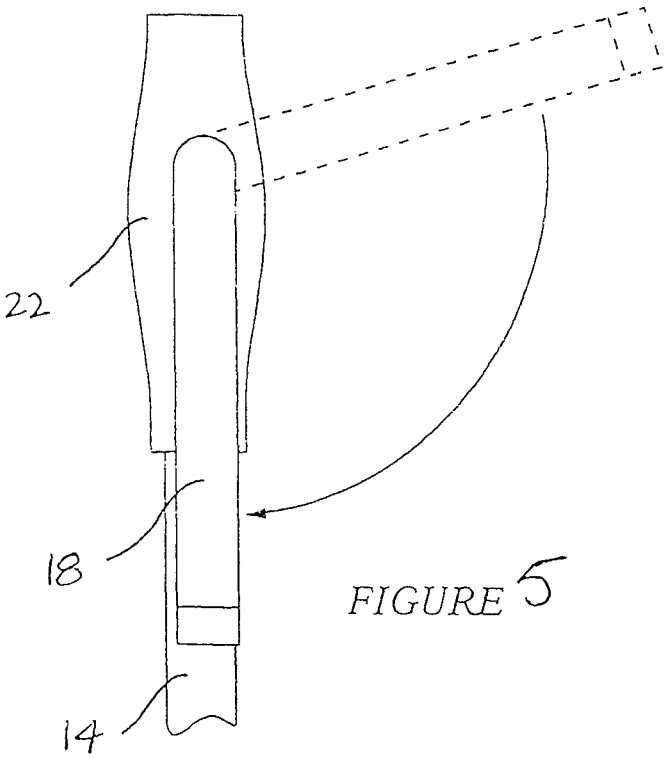
FIG. 5 is a side view of the upper section of FIG. 3 illustrating the arms in an inoperative position.

As illustrated in FIGS. 4 and 5, the clamping arms (18) are pivotally moveable, with respect to the head-piece 22, between an operative position in which the arms extend laterally relatively to the post (see FIG. 4 and FIG. 5 in dotted outline), and in which position the violin can be inserted and clamped between the arms, and an inoperative or storage position in which the arms lie longitudinally adjacent the post (see FIG. 5).

The arms can be coated with a pressure-absorbing material, for example, foam rubber, to provide a degree of protection to the surfaces of the violin which come into contact with the arms.

In a third embodiment of the stand 10C, which is described with reference to FIGS. 6 to 11, and wherein like features bear like designations, each arm (18A and 18B) includes, extending perpendicularly from a respective proximal end (40A and 40B) of each arm, a respective toothed gear bar or rack, respectively designated 42A and 42B.

The head-piece 22 includes, mounted therein, a rotating cylinder 41 within which each rack, projecting from a respective arm, meets in overlapped orientation. Housed within the cylinder is a pinion 44 which is positioned in a space between the overlapping racks (42) to engage with a toothed section of each rack.

Figure 6:
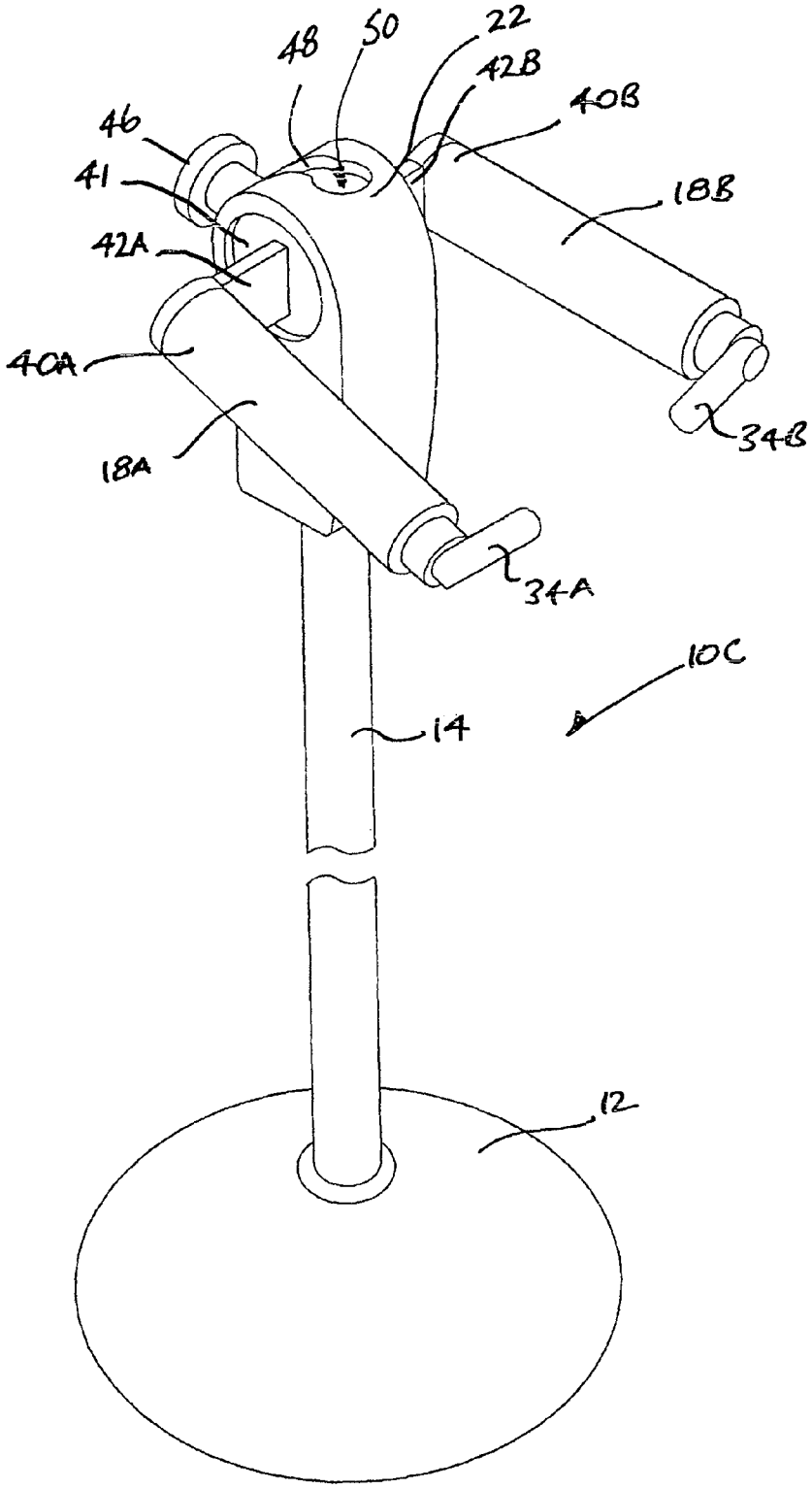
FIG. 6 is an isometric view of the stand in accordance with a third embodiment of the invention.
Figure 7:
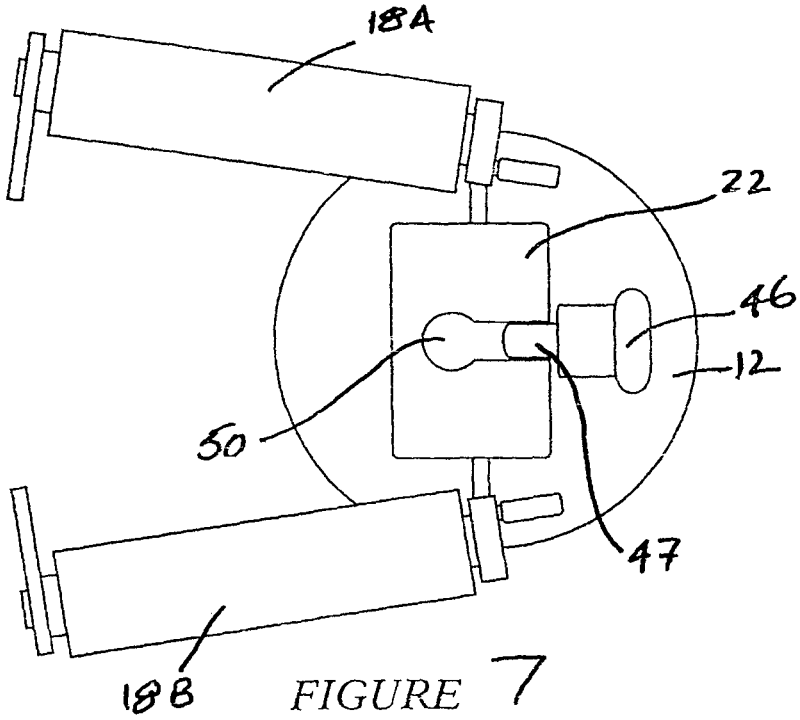
FIG. 7 is a view, in plan, of a clamping assembly of the stand of FIG. 6.

To actuate the pinion in circular motion, to cause variable displacement between the arms, an actuator 46 is provided (see FIGS. 6 and 7). The actuator includes a dial 45, a shoulder portion 52 underlying the dial and a shaft 47 which connects the dial to the pinion and to the cylinder within which it is located. Rotating the dial in either clockwise or counterclockwise rotation causes the pinion 44 to rotate which ultimately translates to linear motion, along an axis 49, to cause the arms (18) to either move inwardly or outwardly, relatively to the pinion, according to requirement.

The head-piece 22 includes a longitudinally arranged slot 48 (see FIGS. 6 and 11) which terminates, at each of its ends, in circular recesses 50A and 50B.

Figure 8:
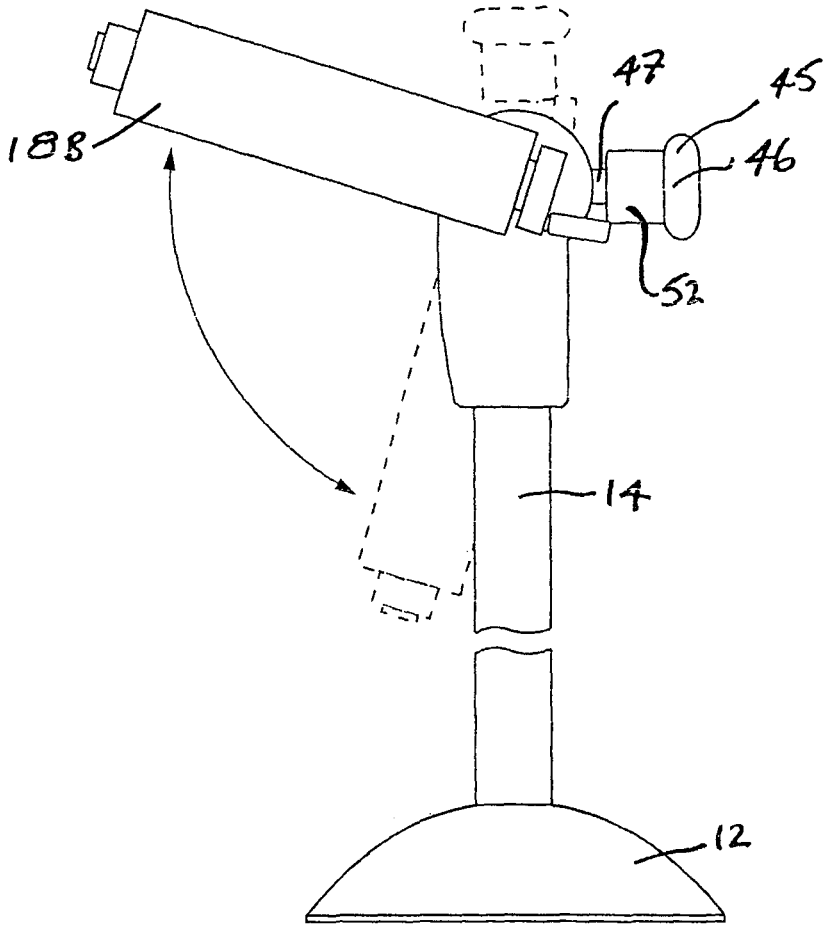
FIG. 8 is a side view of the stand of FIG. 6.
Figure 9:
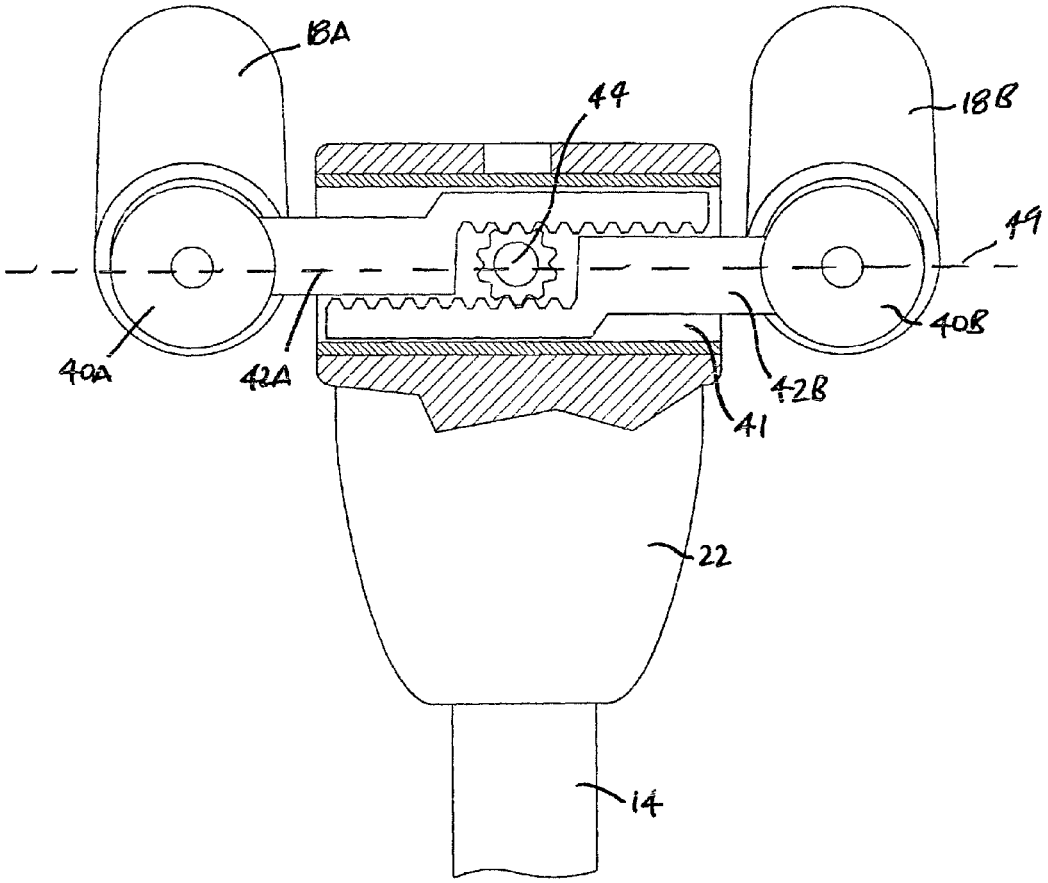
FIG. 9 is a back view of the clamping assembly of the stand of FIG. 6 illustrating a head-piece of the assembly in partial section.
Figure 10:
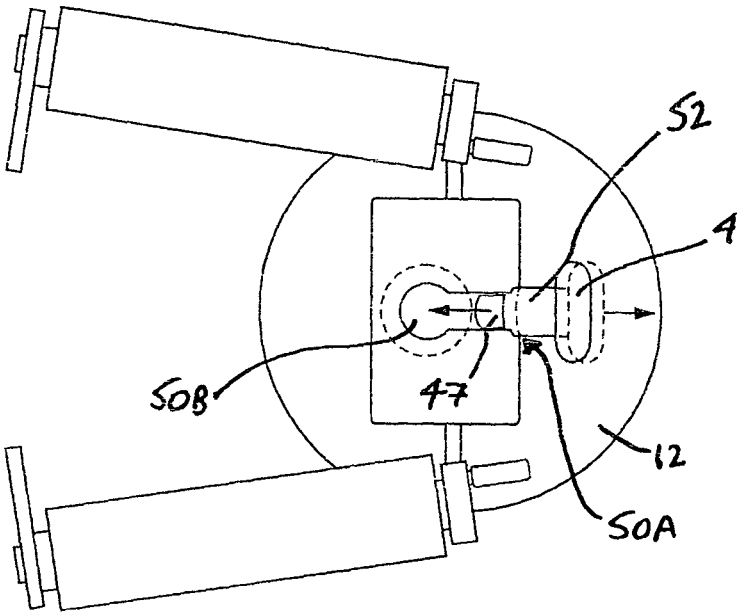
FIG. 10 is a view, in plan, of the clamping assembly of the stand of FIG. 6 illustrating movement of a pivotal actuator.
Figure 11:
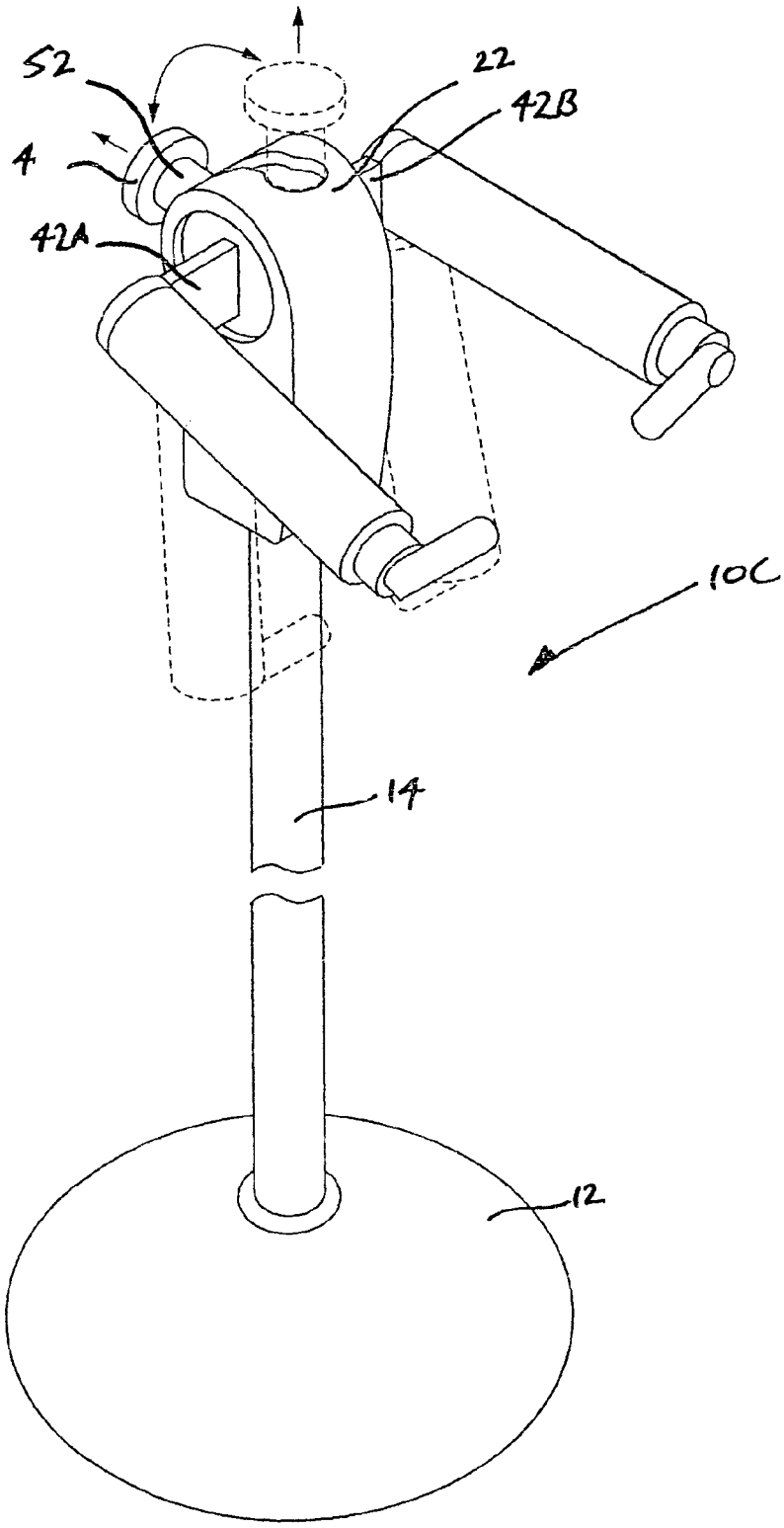
FIG. 11 is an isometric view of the stand of FIG. 6 illustrating pivotal movement of a pair of clamping arms, actuated by the pivotal actuator.

The slot provides a channel along which the shaft 47 can travel when using the actuator 46 to pivot the clamping arms (18) between an operative position, as illustrated in FIGS. 6 and 11, in which the arms extend laterally relatively to the post, and an inoperative or storage position, as illustrated in dotted outline in FIGS. 8 and 11, in which the arms lie longitudinally adjacent the post 14.

To move the arms to the inoperative position as illustrated in FIG. 11, a user will take hold of the dial 45, which is spring-loaded to be inwardly biased so that a shoulder portion 52 is partially located within the lower recess 50A, and withdraw the dial outwardly (as indicated by a directional arrow in FIGS. 10 and 11) against the biasing force to free the shoulder portion 52 from the confines of recess 50A. The shaft 47, attached as it is to the pinion and to cylinder 41 is now free to move along the slot 48 as the user moves the dial in an upward direction, until the shaft reaches recess 50B and at which point the biasing action of the spring will draw the shoulder portion into the confines of recess 50B (illustrated in dotted outline in FIG. 11).

This action, as described above, has the effect of rotating the cylinder 41 in a clockwise direction to cause the clamping arms (18), attached to the cylinder by their respective racks (42), to pivot from the operative position to the inoperative position (illustrated in dotted outline in FIG. 11). Reversing the action, by withdrawing the dial and moving the dial downwardly, will cause the clamping arms to move back to the operative position. Therefore the two positions, the operative position and the inoperative position, are positionally preset by the recesses 50A and 50B at each end of the slot 48.

The invention claimed is:

1. A stand for a musical instrument, the stand comprising:
a ground-engaging base;
a post extending from the base; and
a clamp assembly attached to the post,
wherein the clamp assembly includes a pair of clamping arms, a head-piece, a rotatable cylinder mounted within the head-piece, two racks laterally and inwardly extending from the clamping arms, respectively, and a pinion housed in the rotatable cylinder, wherein the headpiece is mounted on a top portion of the post,
wherein the racks lie, at least partially, in parallel relationship with one another, and are located, at least partially, within the rotatable cylinder,
wherein the pinion is arranged to engage a toothed section of each of the racks, and can be actuated to variably space the clamping arms relative to one another, along an axis transverse to the post, to detachably engage a respective side of the instrument, when placed therebetween, to hold the instrument in a convenient position for a user to access and play.

2. A stand according to claim 1, wherein the clamping arms are pivotally moveable with respect to the head-piece between operative positions in which the clamping arms extend laterally relatively to the post and inoperative or storage positions in which the clamping arms lie longitudinally adjacent the post.

3. A stand according to claim 2, wherein the clamping arms are orientated, in the operative positions, in a range of 15° to 25° above the horizontal to gravitationally aid in keeping the instrument clamped within the clamping arms.

4. A stand according to claim 3, wherein the clamp assembly includes an actuator which is attached to the pinion to transmit rotational motion, applied thereto, to the pinion.

5. A stand according to claim 4, wherein the head-piece includes a slot which allows travel of the actuator when used to pivotally move the clamping arms between the operative positions and the inoperative positions.

6. A stand according to claim 5, wherein the slot has, at its ends, end formations which operationally define the operative positions and inoperative positions respectively.

7. A stand according to claim 6, wherein the actuator includes a hand-help member, a stop formation portion underlying the member and a shaft which connects the member to the pinion.

8. A stand according to claim 7, wherein the member includes a biasing member which attaches the member to the shaft and which biases the member axially inwardly.

9. A stand according to claim 8, wherein the stop formation is complementally shaped to the slot end formation to locate therewith when the member is inwardly biased to prevent movement of the actuator along the slot.

* * * * *